US008072164B2

(12) United States Patent
Ilyes et al.

(10) Patent No.: US 8,072,164 B2
(45) Date of Patent: Dec. 6, 2011

(54) UNIFIED 0-10V AND DALI DIMMING INTERFACE CIRCUIT

(75) Inventors: Laszlo S. Ilyes, Richmond Heights, OH (US); Bruce Roberts, Mentor-on-the-Lake, OH (US); Joseph G. Elek, North Ridgeville, OH (US); Tony Aboumrad, Parma, OH (US)

(73) Assignee: General Electric Company, Schenectady, NY (US)

( * ) Notice: Subject to any disclaimer, the term of this patent is extended or adjusted under 35 U.S.C. 154(b) by 666 days.

(21) Appl. No.: 12/259,492

(22) Filed: Oct. 28, 2008

(65) Prior Publication Data

US 2010/0102747 A1 Apr. 29, 2010

(51) Int. Cl.
*H05B 41/36* (2006.01)
*H05B 37/00* (2006.01)

(52) U.S. Cl. ..... 315/308; 315/307

(58) Field of Classification Search ..... 315/291, 315/307, 308, 279, 282, 292
See application file for complete search history.

(56) References Cited

U.S. PATENT DOCUMENTS 6,181,588 B1 1/2001 Kates et al.
6,762,570 B1 * 7/2004 Fosler ..... 315/312
7,187,136 B2 * 3/2007 Fiorello ..... 315/224
7,265,499 B2 * 9/2007 Ball ..... 315/282
2004/0140777 A1 7/2004 Fosler
2005/0179404 A1 8/2005 Veskovic et al.
2005/0225257 A1 10/2005 Green

FOREIGN PATENT DOCUMENTS

WO 0041287 A 7/2000

OTHER PUBLICATIONS

PCT/US2009/057793, Search Report and Written Opinion, Jul. 14, 2010.

* cited by examiner

*Primary Examiner* — Douglas W Owens
*Assistant Examiner* — Minh D A
(74) *Attorney, Agent, or Firm* — Fay Sharpe LLP

(57) ABSTRACT

Systems and methods are disclosed that facilitate switching a lamp ballast between DALI and analog control states as a function of control state information stored prior to the ballast being powered of and control information received by an interface circuit for the ballast circuit. A depolarization circuit is coupled to the interface circuit and ensures consistent polarity across a rectifier circuit regardless of the polarity of two control wires coupled to a miswiring protection circuit in the interface circuit. In this manner, a single interface circuit provides dual 0-10V analog and DALI control for dimming a lighting device regardless of whether a wall-mounted controller coupled to the interface circuit is an analog or a DALI type controller, thereby mitigating a need to switch out a ballast circuit coupled to the lighting device when changing between DALI and analog type controllers.

12 Claims, 5 Drawing Sheets

UNIFIED 0-10V AND DALI DIMMING INTERFACE CIRCUIT

BACKGROUND OF THE INVENTION

The present application is directed to electronic interface circuits. It finds particular application in conjunction with digital addressable lighting interface (DALI) circuits and 0-10V dimming interface circuits, and will be described with the particular reference thereto.

Classical 0-10V dimming interface circuits employ a 0-10V control signal to dim a lighting device over a practical range of output power. Light level is determined by an analog voltage level set by a user in the range of 0-10V. Such circuits have a positive-negative polarity that must be adhered to in order for the system to function properly. The interface circuit is required to provide a controlled current that is electrically isolated from the electronics of the lighting device so that passive control components such as contacts and potentiometers may be used to dim the lighting device.

Other interface circuits allow lighting devices to be dimmed using the DALI standard protocol. Such circuits are generally not polarized, allowing the control wires to be interchanged. Light level is controlled by digital messages that are passed to a DALI control bus, at up to 22V according to the standard.

Attempts to depolarize a 0-10V power supply interface have thus far included using a synchronous rectifier bridge that requires continuous commutation and a diode bridge in the depolarizing circuit.

The following contemplates new methods and apparatuses that overcome the above referenced problems and others.

BRIEF DESCRIPTION OF THE INVENTION

According to an aspect, a dual-control analog and DALI interface circuit comprises an isolating inverter circuit that is coupled to a current regulator and a voltage regulator, and a microcontroller that is coupled to the isolating inverter circuit, the current regulator, and the voltage regulator. The interface circuit further comprises a depolarizing circuit that ensures a desired polarity at a rectifier circuit that is inductively coupled to the isolating inverter circuit.

According to another aspect, a method of providing dual 0-10V analog and DALI control of a ballast circuit for dimming a lighting device comprises powering ON the ballast circuit, reading control state information stored in memory and describing a control state of the ballast circuit prior to entering an OFF state, and determining whether the ballast circuit was in a DALI control state prior to entering the OFF state. The method further comprises employing received DALI commands to control the ballast circuit if the ballast circuit was in a DALI control state prior to entering the OFF state, and employing received analog control commands to control the ballast circuit if the ballast circuit was in an analog control state prior to entering the OFF state.

According to yet another aspect, a computer-readable medium stores computer-executable instructions for execution by a processor, the instructions including reading, upon powering ON a lighting device ballast circuit, control state information stored in memory and describing a control state of the ballast circuit prior to entering an OFF state, and determining whether the ballast circuit was in a DALI control state prior to entering the OFF state. The instructions further include employing received DALI commands to control the ballast circuit if the ballast circuit was in a DALI control state prior to entering the OFF state, and employing received analog control commands to control the ballast circuit if the ballast circuit was in an analog control state prior to entering the OFF state. Additionally, the computer-readable medium stores instructions for monitoring incoming control signals for DALI control commands when the ballast is in the analog control state, updating the control state information in the memory to indicate that the ballast circuit is in the DALI control state upon detection of the valid DALI control command. Furthermore, the computer-readable medium stores instructions for monitoring incoming control signals for analog control commands when the ballast is in the DALI control state, and updating the control state information in the memory to indicate that the ballast circuit is in the analog control state upon detection of the analog control command.

DETAILED DESCRIPTION OF THE INVENTION

Figure 1A:
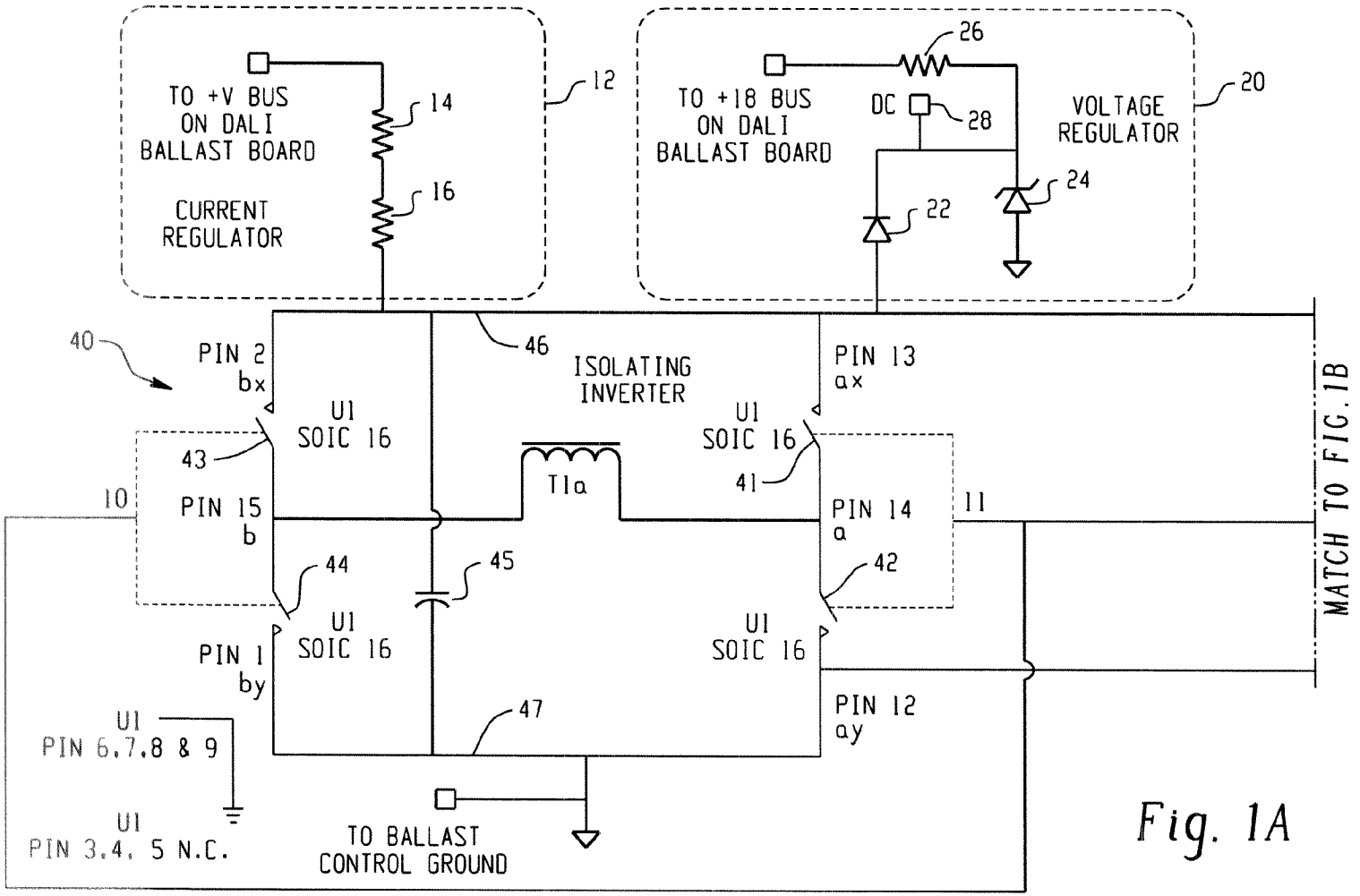
FIGS. 1A and 1B illustrate the interface circuit or ballast, which includes a current regulator comprising a pair of resistors in series between a positive voltage bus on a DALI ballast board and an isolating inverter in the interface circuit.

With reference to FIGS. 1A-3, a dual mode interface circuit, or ballast circuit, 10 is illustrated that facilitates using either or both or a 0-10V control signal and DALI control signals to control dimming of a single lamp. The interface circuit 10 includes a depolarizing circuit 110 (FIG. 2) that allows a 0-10V interface to be used in a non-polarized fashion. Like a DALI control circuit, the leads of the 0-10V interface may be interchanged without affecting circuit performance. That is, the depolarizing circuit 140 permits two control wires to be applied from the circuit 10 to a lamp or other device regardless of the polarity thereof. The interface 10 also includes a miswiring protection circuit 140 (FIG. 3) that prevents the ballast 10 from being damaged due to accidental connection of the control wires to mains or other high-voltage wiring. That is, the miswiring protection circuit protects the interface circuit should the control wires be inadvertently wired to the mains during installation. The miswiring protection circuit is configured such that it ensures that the ballast circuit operates regardless of the wiring of two interchangeable control wires coupled to the miswiring protection circuit and to a control device.

In this manner the interface circuit 10 provides a fast, electrically isolated interface that allows AC and/or DC signals to be received by a microcontroller that regulates a parameter of the device to which it is coupled, such as luminosity of a lighting device. For instance, the interface circuit 10 permits data to be transmitted from the microcontroller to the control wires, as required by DALI standards, as well as permits low-level current to pass through an isolation barrier to the control leads, as required by 0-10V dimming standards. Only two control wires need be applied to the lighting device (e.g., discharge lamp, incandescent lamp, high-intensity discharge lamp, fluorescent lamp, etc.), and the lighting device is not sensitive to the polarity of the control wires regardless of which control method (e.g., 0-10V or DALI) is employed. In the case of 0-10V dimming, the interface circuit provides a low-level current supply to the control wires to provide passive dimming control. In the case of DALI dimming, the control interface allows the lighting device to receive and transmit coded DALI packets per the IEC standard over the same two control wires used for 0-10V dimming. In both cases, the control wires are electrically isolated from mains that supply the lighting device with power.

The dual 0-10V-DALI ballast circuit 10 permits a lighting device to be employed, for instance, in analog 0-10V mode for an unspecified time period (e.g., weeks, months, years, etc.). If and when a wall-mounted analog control unit is replaced with a DALI controller, the change is sensed and the ballast continues working, without requiring an operator to change out the ballast coupled to the lighting device (e.g., in a ceiling or other relatively inaccessible place). Another advantage resides in the ability of a purchaser (e.g., a construction company or the like) to purchase large numbers of the ballast circuits without knowing a priori whether analog or DALI controllers will be used therewith. That is, a purchaser may purchase a number of the ballasts and then employ analog, DALI, or both control mechanisms to control lighting devices coupled to the ballasts.

Another advantage resides in the mitigation of a need for a retailer or manufacturer to maintain separate inventories of DALI and analog ballasts, because the dual-mode ballast 10 can operate in either mode. Moreover the dual modality of the circuit 10 can be adjusted to perform with analog and any suitable digital control logic, and is not limited to DALI control.

Figure 1B:
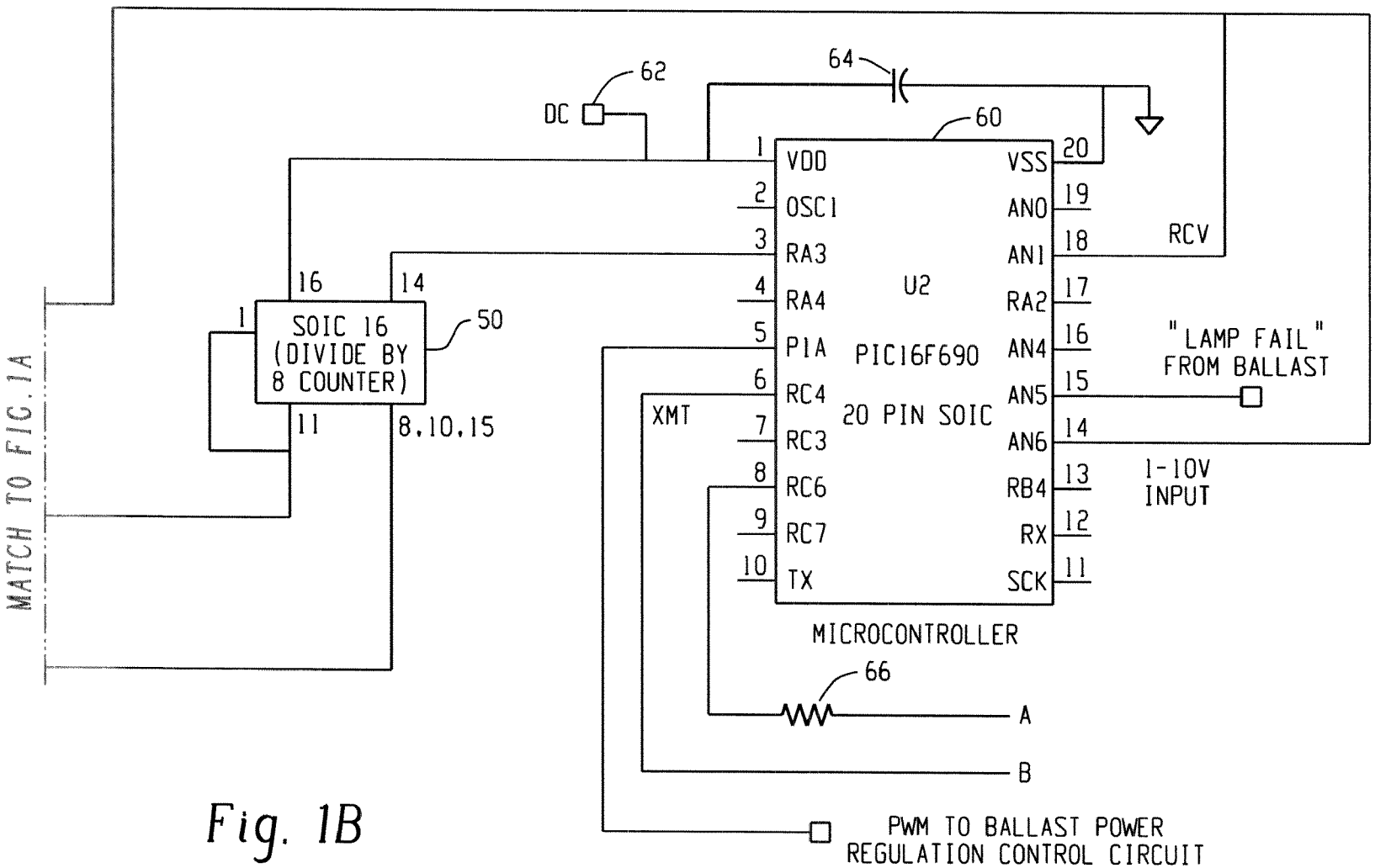

Accordingly, FIGS. 1A and 1B illustrate the interface circuit 10, which includes a current regulator 12 comprising a pair of resistors 14, 16 in series between a positive voltage bus on a DALI ballast board and an isolating inverter 40 in the interface circuit 10. In one example, the resistors 14, 16 are 1MΩ resistors. In another example, a single 2MΩ resistor is used in place of the two 1MΩ resistors. It will be appreciated that the resistor foregoing resistor values, as well as any other component values presented herein, are provided for illustrative purposes only, and that the herein-described embodiments are not limited to the provided component values, but rather may comprise any suitable component values to achieve the desired circuit features and/or functionality.

A voltage regulator 20 is coupled to the isolating inverter portion 40 of the circuit and to the positive voltage bus on the DALI ballast. The voltage regulator 20 includes a clamping diode 22 that is coupled to the isolating inverter 40. The diode 22 and the Zener diode 24 are coupled to a resistor 26 and a regulated DC output supply voltage 28. The Zener diode is further coupled to a signal ground. In one example, the resistor 26 is a 3.3 kg resistor. In another example, the DC supply output 28 is a 5V supply voltage. In yet another example the diode 22 is a 1N4148 diode.

The isolating inverter 40 includes a transformer winding T1*a* (e.g., 20 mH or the like) that is couple to an integrated circuit U1, such as a 16-pin small-outline integrated circuit (SOIC). In one example, the integrated circuit U1 is a CD4053 chip. The winding T1*a* is coupled to the microchip U1 at one end to pin 14 and at the other end to pin 15. Pin 14 is coupled to pin 13 via a switch 41 and to pin 12 via switch 42. Pin 15 is coupled to pin 1 via a switch 43 and to pin 2 via a switch 44. Switches 41 and 42 are further coupled to pin 11 of the chip U1, and switches 43 and 44 are connected to pin 10 thereof. Pin 10 is also coupled to pin 11. Pins 3, 4, and 5 are not connected, and pins 6, 7, 8, and 9 are coupled to earth ground. A capacitor 45 is provided across the isolating inverter 40, and is coupled at one end to pins 2 and 13 via a bus 46, and at the other end to pins 1 and 12 via a bus 47. In one example, the capacitor 45 is a 2.2 nF capacitor. In another example, the capacitor has a cutoff frequency of approximately 12 kHz. However, it will be appreciated that the capacitor may have any suitable capacitance that permits a DALI signal to pass. The bus 47 is coupled to a ballast control ground (not shown), as well as to signal ground.

The interface circuit 10 further includes a divide-by-8 counter (DB8C) 50, that is coupled to the chip U1 and to a microcontroller chip 60. In one embodiment, the BD8C 50 is a SOIC 16-pin chip, such as a MC14018B or the like, and the microcontroller 60 is a programmable intelligent computer (PIC), such as a 20-pin SOIC (e.g., a PIC16F690 or the like). Pins 1 and 11 of the DB8C are coupled to each other, to pin 11 of the chip U1, as well as to pin 10 of the chip U1. Pins 8, 10, and 15 of the DB8C are coupled to pin 12 of the chip U1.

Pin 1 of the microcontroller 60 and pin 16 of the DB8C 50 are coupled to each other, to a DC source 62 (e.g., in one embodiment, the source 62 is the regulated supply voltage output 28 from the voltage regulator 20), and to a capacitor 64. In one example, the DC source is a 5V DC source. The capacitor 64 is coupled across pin 1 (Vdd) and pin 20 (Vss) of the microcontroller 60, as well as to a signal ground. In one example, the capacitor 64 is a 0.1 μF capacitor.

Pin 3 (RA3) of the microcontroller 60 is coupled to pin 14 of the DB8C 50. Pin 5 (P1A) of the microcontroller 60 is coupled to a pulse width modulation (PWM) component in a ballast power regulation control circuit (not shown). Pin 6 (RC4) transmits to node B, which is coupled to a miswiring protection circuit described in greater detail with regard to FIG. 3. Pin 8 (RC6) is coupled to a resistor 66, which in turn is coupled to a node A. Node A is coupled to the miswiring protection circuit, which is described in greater detail with regard to FIG. 3. In one example, the resistor 66 is a 10 kΩ resistor.

Pin 14 (AN6) of the microcontroller 60 receives a 0-10V input and is coupled to pin 18 (AN1) of the microcontroller 60 and to the bus 46 of the isolating inverter 40. Pin 15 (AN5) is coupled to a lamp ballast circuit and receives a lamp failure signal in the event that a lamp failure occurs. The remaining pins (pins 2, 4, 7, 9, 10, 11, 12, 13, 16, 17, and 19) of the microcontroller are not connected.

Figure 2:
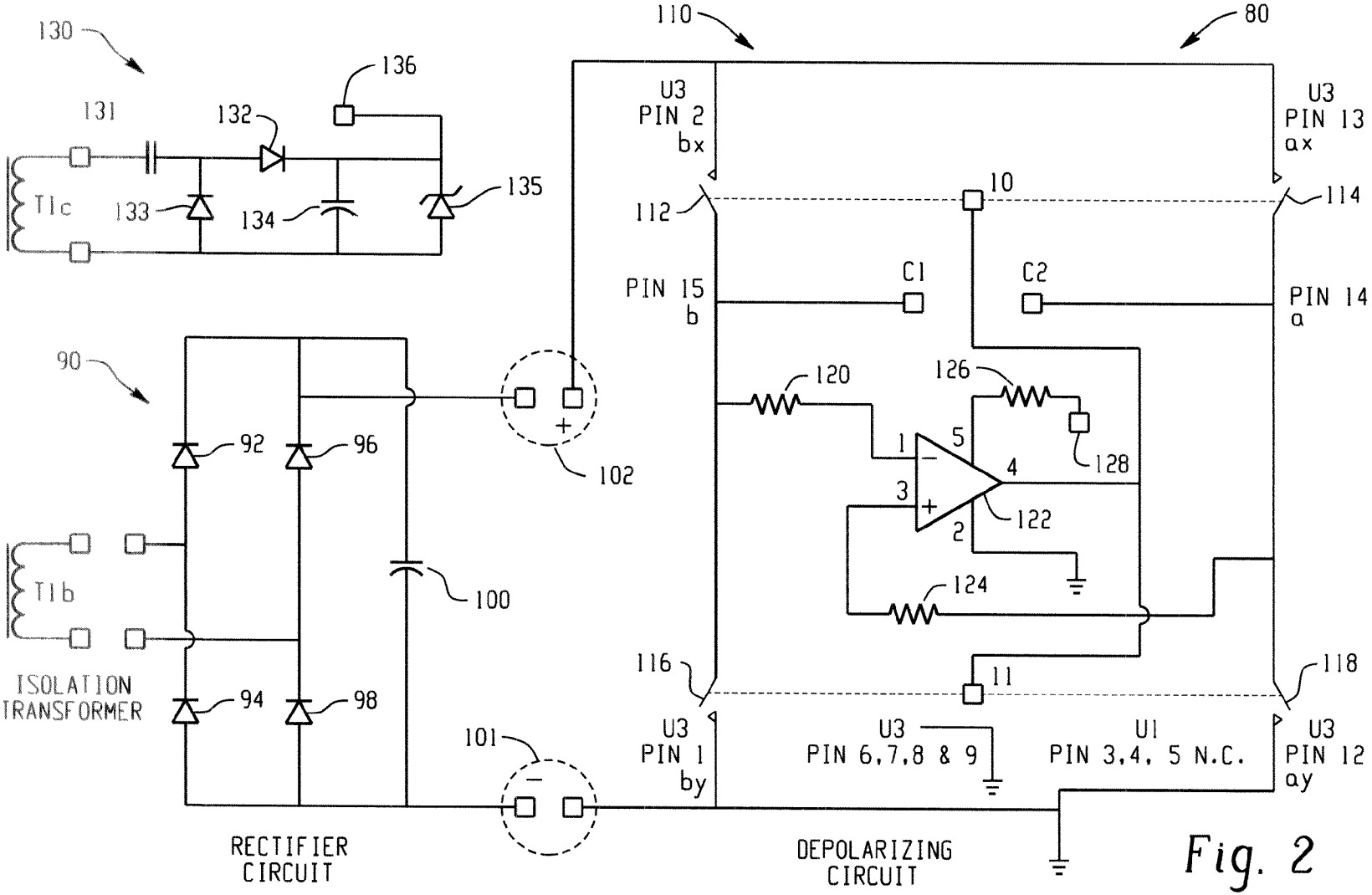
FIG. 2 illustrates a portion of the interface circuit that includes an isolation transformer, a rectifier circuit, and a depolarization circuit.

FIG. 2 illustrates a portion 80 of the interface circuit 10 that includes an isolation transformer T1*b*, a rectifier circuit 90, and a depolarization circuit 110. The isolation transformer T1*b* is inductively coupled to the transformer winding T1*a* of FIG. 1A, and is coupled to the rectifier circuit 90. That is, the isolating transformer T1*b* is coupled at a first end between diodes 92 and 94, and at a second end between diodes 96 and 98. A capacitor 100 is coupled to diodes 92 and 96 at a first end, and to diodes 94 and 98 at a second end. The capacitor 100 is further coupled to a negative terminal 101 of the depolarizing circuit 110. The diodes 92 and 94 are coupled to a positive terminal 102 of the depolarizing circuit 110. In one example, the diodes 92, 94, 96, 98 are 1N4148 diodes, and the capacitor is a 2.2 nF capacitor.

Figure 3:
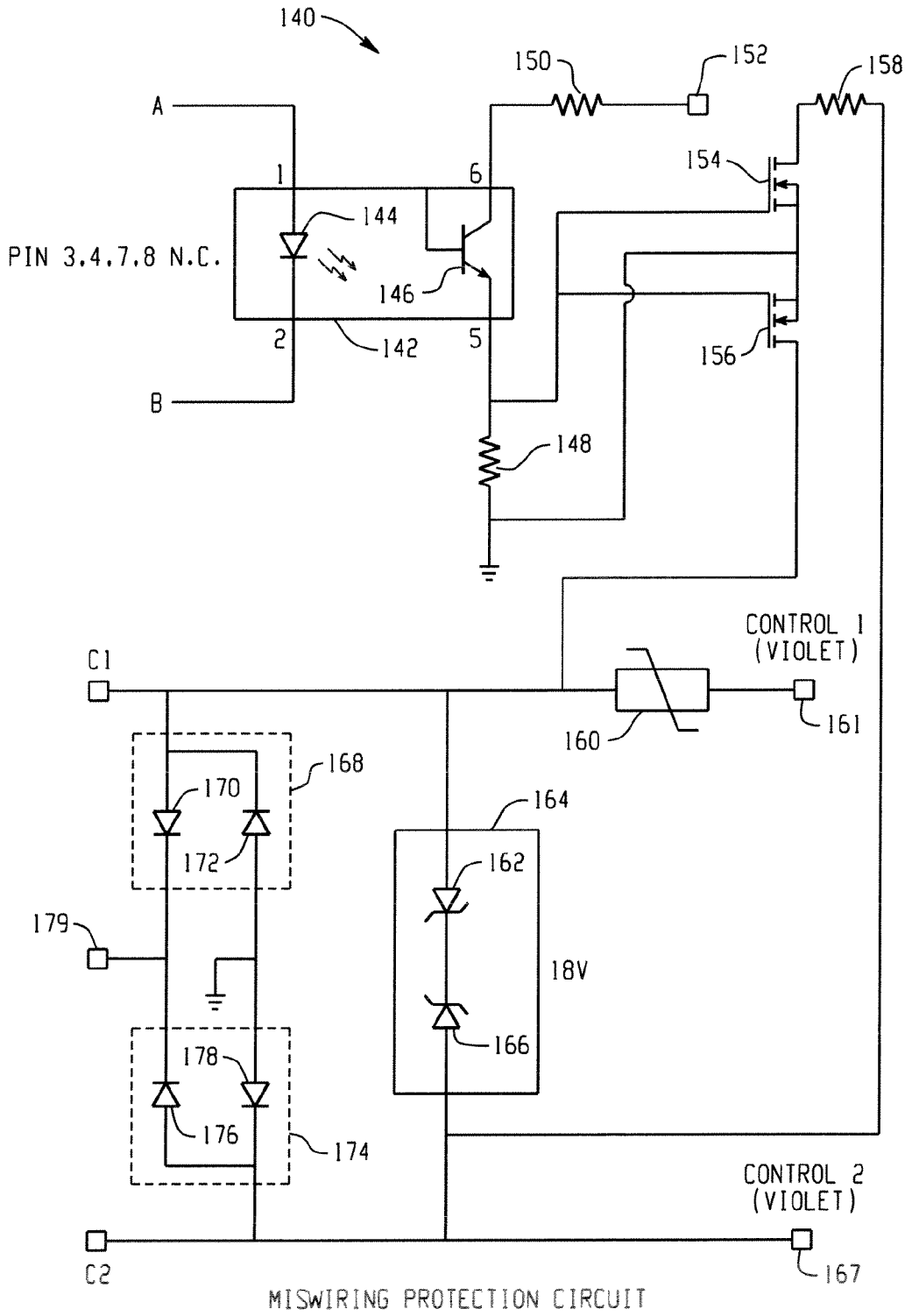
FIG. 3 illustrates a miswiring protection circuit (MPC), which is part of the 0-10V-DALI interface circuit.

The depolarizing circuit 110 includes an integrated circuit U3. In one example the integrated circuit U3 is a CD4053 chip. The integrated circuit U3 comprises a plurality of switches that are selectively engaged to ensure that the polarity across the terminals 101 and 102 remain constant, which ensures proper operation of the rectifier circuit (and thus the ballast 10) regardless of the configuration of two control leads or wires coupled to the miswiring protection circuit (FIG. 3). Pin 2 of the chip U3 is coupled to the positive terminal 102 and to a switch 112. Pin 2 is further coupled to pin 13 of the chip U3, which in turn is coupled to a switch 114. Pin 10 of the chip U3 is coupled to switches 112 and 114.

Pin 1 of the chip U3 is coupled to the negative terminal 101, to a switch 116, and to pin 12 of the chip U3. Pin 12 is coupled to a switch 118. Pins 1 and 12 are also coupled to earth ground. Pin 11 of the chip U3 is coupled to both switch 116 and switch 118.

Pin 14 of the chip U3 is coupled to switches 114 and 118, as well as to a terminal C1 that is coupled to the miswiring protection circuit 140 (FIG. 3). Pin 15 of the chip U3 is coupled to switch 112 and switch 116, as well as to terminal C2 of the miswiring protection circuit 140 (FIG. 3). Pin 15 of the chip U3 is further coupled to a resistor 120, which is in turn coupled to pin 1 of a comparator 122. Pins 3, 4, and 5 of the chip U3 are not connected, and pins 6, 7, 8, and 9 are connected to earth ground.

In one example, the comparator 122 is a LM397 voltage comparator. Pin 2 of the comparator 122 is coupled to earth ground. Pin 3 of the comparator 122 is coupled to a resistor 124, which in turn is coupled to pin 14 of the chip U3. Pin 4 of the comparator 122 is coupled to pins 10 and 11 of the chip U3. Pin 5 of the comparator 122 is coupled to a resistor 126, which in turn is coupled to a voltage source or terminal 128. According to an example, the resistors 120 and 124 are 150 kΩ resistors, the resistor 126 is a 100 kΩ resistor, and the voltage source 128 is a 19V source.

Still referring to FIG. 2, an isolated power supply circuit 130 is illustrated, which drives the switches of chip U3. The circuit 130 includes a transformer winding T1*c*, which is inductively coupled to windings T1*b* and T1*a*. A first end of the winding T1*c* is coupled to capacitor 131, which in turn is coupled to the anode of diode 132 and to the cathode of diode 133. The cathode of diode 132 is coupled to a capacitor 134, to a cathode of a Zener diode 135, and to a terminal 136. A second end of the transformer winding T1*c* is coupled to the anode of diode 133, the capacitor 134, and the anode of Zener diode 135. In one example the capacitor 131 is a 0.01 nF capacitor, and the capacitor 134 is a 10 μF capacitor. In another example, the diodes 132, 133 are 1N4148 diodes, and the Zener diode is a 19V Zener diode. In another example, the terminal 136 is a 19V terminal.

FIG. 3 illustrates a miswiring protection circuit (MPC) 140, which is part of the 0-10V-DALI interface circuit 10. The MPC 140 includes an 8-pin SOIC phototransistor 142, which has a light-emitting diode (LED) 144 that is coupled pin 1 of the phototransistor 142, which in turn is coupled to node A (e.g., resistor 66 of FIG. 1B). The LED 144 is further coupled to pin 2 of the phototransistor 142, which is coupled to node B (e.g., pin 6 of the microcontroller 60 of FIG. 1B). Pin 5 of the phototransistor 142 is coupled to an emitter of a transistor 146, and to a first end of a resistor 148 that is coupled to earth ground at a second end. In one example the resistor 148 is a 100 kΩ resistor. Pin 6 of the phototransistor 142 is coupled to a resistor 150, which in turn is coupled to a voltage source 152. In one example, the resistor 150 is a 100 kΩ resistor, and the voltage source 152 is 19V source.

Pin 5 is additionally coupled to a gate of a first metal-oxide-semiconductor field-effect transistor (MOSFET) 154 and to a gate of a second MOSFET 156. The second end of the resistor 148 is coupled to the source of each MOSFET 154, 156. The drain of MOSFET 154 is coupled to a resistor 158 (e.g., a 910Ω resistor or the like), while the drain of the MOSFET 156 is coupled to a positive temperature coefficient (PTC) thermistor 160 (e.g., 500Ω or the like), which in turn is coupled to a first control wire 161. The drain of the MOSFET 156 and the thermistor 160 are additionally coupled to a first Zener diode 162 in a dual Zener diode component 164, and to terminal C1, which is coupled to pin 15 of the chip U3 (FIG. 2).

The resistor 158 is coupled to a second Zener diode 166 in the dual Zener diode component 164, and a terminal C2, which is coupled to pin 14 of the chip U3 (FIG. 2). The resistor 158, the second Zener diode 166, and the terminal C2 are further coupled to a second control wire 167. In one example, the Zener diodes 162, 166 are 18V Zener diodes.

A pair of dual Schottky diode components 168, 174 is coupled across terminals C1 and C1. For instance, a first dual Schottky diode component 168 comprises a Schottky diode 170 having an anode connected between the terminal C1 and the thermistor 160, and to a cathode of a Schottky diode 172. The cathode of the Schottky diode 170 is coupled to a cathode of a Schottky diode 176 in the second dual Schottky diode component 174. The anode of Schottky diode 176 is coupled to the cathode of Schottky diode 178, which in turn are coupled to a bus between terminal C2 and the second control wire 167. The anodes of diodes 172 and 178 are coupled to earth ground, and the cathodes of diodes 170 and 176 are coupled to a voltage terminal (e.g., 19V or the like).

Figure 4:
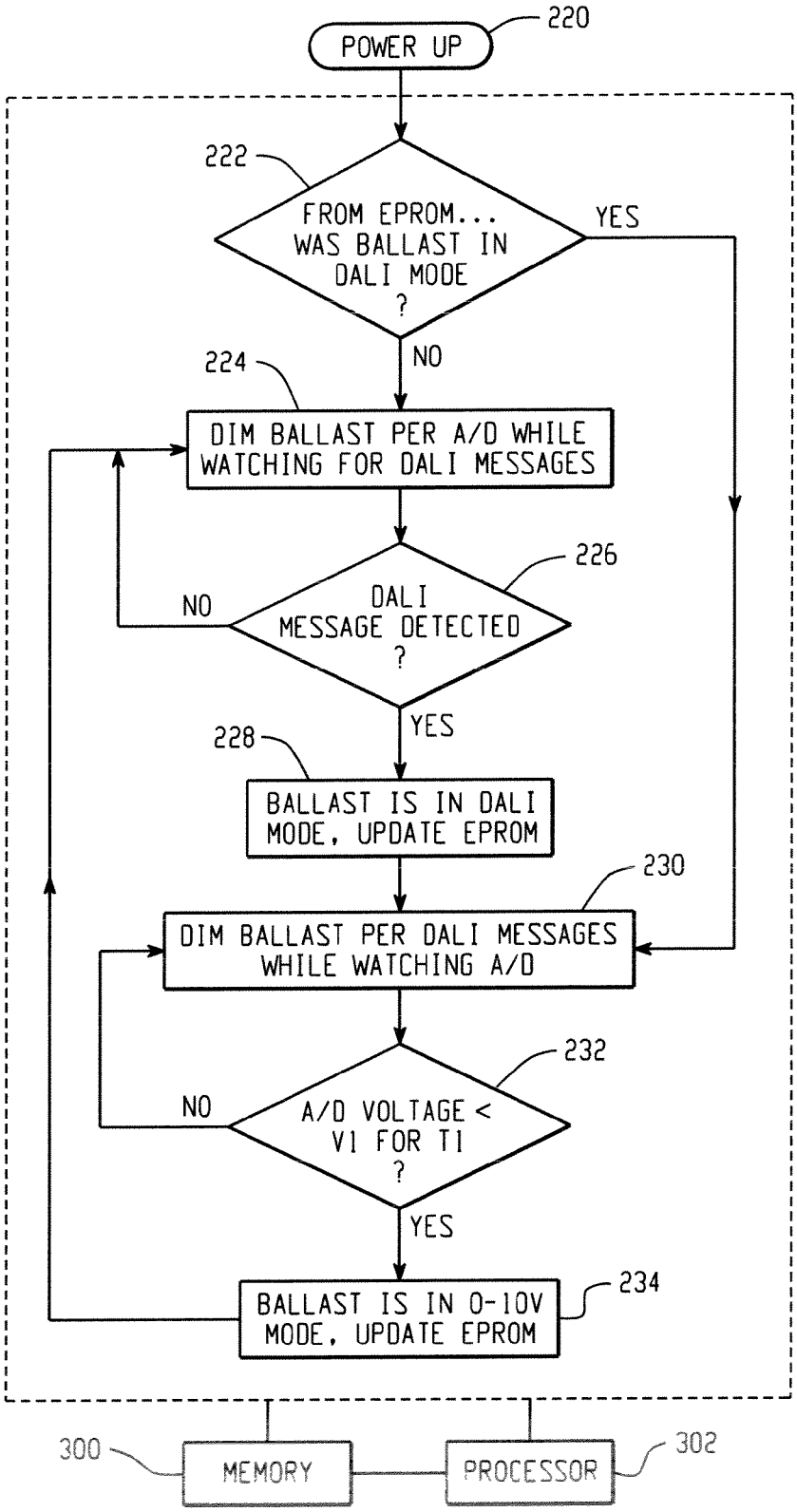
FIG. 4 illustrates a method of providing dual 0-10V and DALI control for a lighting device (e.g., a discharge lamp or the like), such as may be employed using the circuitry described with regard FIGS. 1A-3 and in accordance with various aspects described herein.

FIG. 4 illustrates a method of providing dual 0-10V and DALI control for a lighting device (e.g., a discharge lamp or the like), such as may be employed using the circuitry described with regard to FIGS. 1A-3 and in accordance with various aspects described herein. The very first time a ballast is powered up at a customer site, it is considered to be in 0-10V control mode. Under this assumption, if the ballast is on a 0-10V controller, it will work immediately. If the ballast is on a DALI controller, it will be fully on (e.g., in a brightest state). On the first appearance of a legal DALI message, the ballast will revert to a DALI mode of operation. The state of the ballast (DALI or 0-10V) can be recorded in non-volatile memory (not shown), so that following a power interruption, the ballast will return to operation in the proper state. Since it is not a normal condition for DALI ballasts to be turned on/off using the mains, it is also acceptable to go straight to 0-10V control mode following a power-up. Using the algorithm of FIG. 4, it is possible to switch a powered-ON ballast between 0-10V operation and DALI operation at will, by swapping controllers and issuing reasonably simple control requests with them. If power is cycled, the ballast retains its previous state in an electrically programmable read-only memory (EPROM).

Accordingly, at 220, the ballast is powered up. At 222, a determination is made regarding whether the ballast was in DALI mode prior to powering off. The determination can be made by reading most recent stored state of the ballast control from a memory or computer-readable medium employed to store the control state of the ballast. If it is determined that the ballast was in DALI mode prior to powering off, then the method proceeds to 230, where the ballast is controlled (e.g., dimmed and/or brightened) according to received DALI messages, while monitoring for A/D signals that might indicate a switch to 0-10V control mode.

If it is determined that the ballast was not in DALI mode prior to shutting down, then at 224, the ballast is controlled using A/D signals (e.g., in 0-10V control mode) while monitoring for incoming DALI messages that might indicate a switch to DALI mode. At 226, a determination is made regarding whether a DALI message has been detected. If no DALI message has been detected, the method reverts to 224 for continued 0-10V control of the ballast.

If a DALI message is detected at 226, then at 228 the ballast is recognized as being in DALI control mode, and the memory is updated to reflect the state of the ballast control. At 230, the ballast is controlled in DALI mode while monitoring for A/D signals that indicate a switch to 0-10V mode. At 232, a determination is made regarding whether a monitored or detected A/D voltage is less than a predetermined threshold voltage V1 for a predetermined time period T1. In one embodiment, the predetermined threshold voltage is approximately 9V, and the predetermined time period is approximately 20 ms. If the detected A/D voltage is not below V1 for at least T1, then the ballast is still in DALI mode and the method reverts to 230 for continued operation in DALI control mode. If the detected A/D voltage is below V1 for at least the time period T1, then the detected voltage is inconsistent with a valid DALI message, the ballast is determined to be in 0-10V control mode, and the memory is updated to reflect that the ballast is in 0-10V control mode. The method then reverts to 224 for 0-10V control while monitoring for DALI messages.

It will be appreciated that one or more computer-executable algorithms for performing the method of FIG. 4 is stored to persistent memory 300 associated with and/or integral to a device employing the ballast or interface circuit 10. For instance, the method may be stored as a series of computer-executable instructions that are recalled form the memory 300 and executed by a processor 302.

According to an example, the ballast may be powered up and checked for 0-10V and DALI function at a factory site. When the ballast uses its EPROM to save its state during factory testing, the state is simply reset to 0-10V mode during a last functional test.

In another example, by monitoring the A/D signal or the digital inputs during operation, the signal patterns that indicate a switch between 0-10V and DALI need not be restricted to "legal" 0-10V or DALI commands. The ballast may check for frequencies, patterns, or extended digital bursts that are not part of the normal 0-10V or DALI control "language."

In the case of high intensity discharge (HID) lamps, the digital ballast can have a delay (e.g., 15 minutes or some other predetermined delay) added between power-up and an initial dimming command (whether it be DALI or 0-10V).

It is to be appreciated that the foregoing example(s) is/are provided for illustrative purposes and that the subject innovation is not limited to the specific values or ranges of values presented therein. Rather, the subject innovation may employ or otherwise comprise any suitable values or ranges of values, as will be appreciated by those of skill in the art.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A method of providing dual 0-10V analog and DALI control of a ballast circuit for dimming a lighting device, comprising:

powering ON the ballast circuit;

reading control state information stored in memory and describing a control state of the ballast circuit prior to entering an OFF state;

determining whether the ballast circuit was in a DALI control state prior to entering the OFF state;

employing received DALI commands to control the ballast circuit if the ballast circuit was in a DALI control state prior to entering the OFF state; and employing received analog control commands to control the ballast circuit if the ballast circuit was in an analog control state prior to entering the OFF state.

2. The method as set forth in claim 1, further comprising monitoring incoming control signals for DALI control commands when the ballast is in the analog control state.

3. The method as set forth in claim 2, further comprising detecting a valid incoming DALI control command.

4. The method as set forth in claim 3, further comprising updating the control state information in the memory to indicate that the ballast circuit is in the DALI control state upon detection of the valid DALI control command.

5. The method as set forth in claim 1, further comprising monitoring incoming control signals for analog control commands when the ballast is in the DALI control state.

6. The method as set forth in claim 5, further comprising detecting an incoming analog control command.

7. The method as set forth in claim 6, further comprising updating the control state information in the memory to indicate that the ballast circuit is in the analog control state upon detection of the analog control command.

8. The method as set forth in claim 6, wherein detecting an incoming analog control command comprises:

comparing an analog voltage associated with an incoming control command to a predetermined threshold voltage V1;

determining whether the analog voltage is less than the predetermined threshold voltage V1 for a predetermined time period T1; and identifying the incoming control command as an analog control command if the analog voltage is less than the predetermined threshold voltage V1 for at least the predetermined time period T1.

9. The method as set forth in claim 8, wherein the predetermined threshold voltage V1 is approximately 9 volts.

10. The method as set forth in claim 8, wherein the predetermined time period approximately 20 ms.

11. A method of providing dual 0-10V analog and DALI control of a ballast circuit for dimming a lighting device, comprising:

reading, upon powering ON a lighting device ballast circuit, control state information stored in memory and describing a control state of the ballast circuit prior to entering an OFF state;

determining whether the ballast circuit was in a DALI control state prior to entering the OFF state;

employing received DALI commands to control the ballast circuit if the ballast circuit was in a DALI control state prior to entering the OFF state;

employing received analog control commands to control the ballast circuit if the ballast circuit was in an analog control state prior to entering the OFF state;

monitoring incoming control signals for DALI control commands when the ballast is in the analog control state;

updating the control state information in the memory to indicate that the ballast circuit is in the DALI control state upon detection of the valid DALI control command;

monitoring incoming control signals for analog control commands when the ballast is in the DALI control state; and updating the control state information in the memory to indicate that the ballast circuit is in the analog control state upon detection of the analog control command.

12. The method as set forth in claim 11, further comprising comparing an analog voltage associated with an incoming control command to a predetermined threshold voltage V1;

determining whether the analog voltage is less than the predetermined threshold voltage V1 for a predetermined time period T1; and identifying the incoming control command as an analog control command if the analog voltage is less than the predetermined threshold voltage V1 for at least the predetermined time period T1.

* * * * *